United States Patent [19]

Seragnoli

[11] 4,085,569

[45] Apr. 25, 1978

[54] DEVICE FOR PREPARING PIECES OF WRAPPING MATERIAL FOR USE AS THE INNER WRAP IN HINGE LID CIGARETTE PACKS

[75] Inventor: Enzo Seragnoli, Bologna, Italy

[73] Assignee: G. D. Societa per Azioni, Italy

[21] Appl. No.: 720,430

[22] Filed: Sep. 3, 1976

[30] Foreign Application Priority Data

Apr. 29, 1974 Italy ..... 3370 A/74

[51] Int. Cl.[2] ..... B65B 41/16

[52] U.S. Cl. ..... 53/389; 83/300; 93/38.2 R

[58] Field of Search ..... 53/208, 389; 83/300, 83/301, 302, 303, 332, 678; 229/44 CB; 206/264; 93/12 C, 58 R, 58.2 R

[56] References Cited

U.S. PATENT DOCUMENTS

| | | | |
|---|---|---|---|
| 1,797,448 | 3/1931 | Sheldon | 83/346 X |
| 2,339,656 | 1/1944 | Shina | 206/264 X |
| 2,870,584 | 1/1959 | Sherrill | 93/12 C |
| 2,963,213 | 12/1960 | Nauhan | 229/44 C B |
| 3,122,040 | 2/1964 | Bishop | 83/332 X |
| 3,224,311 | 12/1965 | Wagner | 83/302 |
| 3,293,962 | 12/1966 | Gianaris | 83/332 |
| 3,412,520 | 11/1968 | Schmermund | 53/208 |
| 3,628,309 | 12/1971 | Seragnoli | 53/230 |
| 3,708,108 | 1/1973 | Rosenburg, Jr. | 229/44 CB |
| 3,847,045 | 11/1974 | Wilhite, Jr. et al. | 83/678 X |

FOREIGN PATENT DOCUMENTS

| | | | |
|---|---|---|---|
| 1,104,234 | 2/1968 | United Kingdom | 83/678 |

*Primary Examiner*—Othell M. Simpson
*Assistant Examiner*—John Sipos
*Attorney, Agent, or Firm*—Robert E. Burns; Emmanuel J. Lobato; Bruce L. Adams

[57] ABSTRACT

A device for preparing pieces of wrapping material for use as inner wraps in hinge-lid cigarette packets. The device comprises a pair of rollers, rotating in opposite directions, which move a web of wrapping material downwards; a scoring disk rotating with one of the rollers to trace a sheet-weakening line of the web, longitudinally in the direction in which the web moves in such a way as to delimitate a part that can be subsequently detached from the web; and cutting rolls which transversely cut the web into individual sheets.

9 Claims, 9 Drawing Figures

DEVICE FOR PREPARING PIECES OF WRAPPING MATERIAL FOR USE AS THE INNER WRAP IN HINGE LID CIGARETTE PACKS

BACKGROUND OF THE INVENTION

This invention relates to wrapping machines in general and, more precisely, to the devices used to infeed pieces of wrapping material to, in particular, cigarette wrapping and packeting machines. It has as its subject a device of this type, improved to prepare pieces of lined foil for use in the formation of the inner wrap in packets of cigarettes of the hinge lid type.

DESCRIPTION OF THE PRIOR ART

Cigarette packets of the hinge lid type consist, as is known, of a wrapper of lined foil, placed in direct contact with the cigarettes, a parallelepiped shaped cardboard box complete with hinged lid and, finally, an overwrap executed with transparent material.

With particular reference to the inner wrap of lined foil, this is wrapped around the batch of cigarettes from all sides, in such a way as to protect them while the subsequent wrapping operations are taking place.

Once the packet has been opened by removal of the transparent overwrap and the lid has been tipped back, in order to render the upper extremities of the cigarettes accessible, a part of the inner lined foil wrap has to be removed.

It is known for this purpose to make the inner wrap out of two separate pieces of lined foil which, when the wrap has been completed, are partly superposed one over the other.

The removable part of the inner wrap can be made in such a way as to cover, in the form of a hood, the entire upper part of the batch of cigarettes, or in a way whereby it covers the front and partially the two sides and the top of the said upper part of the batch of cigarettes.

These inner wrap portions are, conventionally, often made in the form known as "bag type wrap". Such a wrap comprises a U-folded bottom portion, longitudinal flaps folded over one another on both sides of the batch of cigarettes and a top portion closed by folding over one another the lateral flaps.

The known use of two separate pieces of lined foil for an inner wrap, and particularly for a bag type wrap, has the disadvantage that the final operations for the wrapping of the upper part of the batch of cigarettes in a second piece of wrapping material complicate matters considerably. Aside from this problem, there is a need in this case for a separate infeed and wrapping apparatus for the wrapping sheet forming the hood, independent of the infeed and wrapping apparatus for the other wrapping sheet.

With a view to overcoming these difficulities but always bearing in mind the need for the upper part of the wrap to be either totally or partially removed, an inner wrap generally shaped according to the known art is also made of one single piece of lined foil on which one or two weakening lines, transverse and crosswise with respect to the direction in which the web moves and running across its full width, have previously been made.

These transverse weakening lines, consisting of a series of perforations which can be in various shapes and slanting at various angles, are positioned in such a way as to allow, when the wrap is finished, the removal of the front part of the "hood" of the inner wrap (see FIG. 2) or the total removal of the "hood" (FIG. 9).

The conventional techniques described up to here have been completely abandoned by the Applicant's Assignees for their soft packet cigarette packing machine according to U.S. Pat. No. 3,628,309, a very high output speed machine, whereon batches of cigarettes move forward in a crosswise direction transverse with respect to their axes, the purpose of which is to prevent any axial stress from occurring. The transversely moving batch meets a sheet of material which according to the patent, is infed in a direction perpendicular to that in which the batch travels. This sheet is then dragged towards the folding station by the batch of cigarettes.

Fixed and movable folding fingers then attend to the forming of the inner wrap which instead of being wound around the cigarettes themselves, is wound around mechanical members which are gradually inserted between the folding fingers and the cigarettes, to guarantee not only the cigarettes being protected but also wraps being perfectly made in the "soap" style, which will be defined hereinafter.

The excellent results obtained with the machine according to the patent, in the field of packing cigarettes in the soft cup type of packet, make it desirable to use the same technical principles and the same "soap" style of wrap for forming the inner lined foil wrap around batches of cigarettes destined to be packed in packets of the hinge lid types.

This leads to the problem that, to enable the top part of the inner wrap to be easily removed, either totally or in part, at the time the packet is coming into use, a series of perforations need to be made in the wrapping sheet, transversely of the cigarettes. The problem is connected with the fact that according to the patent, the arrangement of the batch of cigarettes is not the same as that of the infeed line for the wrapping material.

SUMMARY OF THE INVENTION

In order to wrap the cigarettes, on a machine generally according to the patent and the "soap" style, it is necessary that at least the principal weakening lines be made longitudinally in the direction in which the lined foil is infed. This direction is shown by vertical arrows in FIGS. 3, 4 and 6.

When it is wished that, on opening the hinge lid HL of the package CP, the entire upper part of the inner wrap is to be detached (see FIGS. 6, 9), the weakening line L' must stretch the full length of the cutting or sheet S. If only the front part of the inner wrap is to be detached (see FIGS. 2, 4), the weakening line L need only run along a part of the length of the sheet S, that is to say, along the section which, when the wrap has been completed, is positioned across the front and part of the sides of the batch of cigarettes.

In this second case, the delimitation of the part to be removed from the sheet is completed by a series of crosswise perforations which extend from the lower extremity of the longitudinal line L to the edge of the sheet.

The present invention, therefore, modifies the device described in the cited Patent, formerly used only for infeeding wrapping sheet material for forming the lined foil inner wrap for soft packets of cigarettes. The modified device is to be used for the preparation of an inner wrap, a part of which is detachable, for each packet of cigarettes of the hinge lid type. The new inner wraps are produced in which is known as the "soap" style (as known from the cited patent, and described hereinafter). A preferred embodiment of the improved device comprises, from top to bottom, means for guiding a single, continuous web of wrapping material to provide inner wrappers of cigarette batches, longitudinally of the length of the web and transversely of the cigarettes to be wrapped in sheets but from the web, these means consisting of a pair of counter rotating rollers; and cutting means, counter rotating at different angular velocities, to separate transversely to the direction of movement of the web, the web into individual pieces; and working in conjunction with the drive rollers, means for scoring a weakening line longitudinally in the direction in which the web moves forward, in order to delimitate at least a part detachable from each piece of wrapping materials, also comprising backup means for the scoring means.

DESCRIPTION OF THE PREFERRED EMBODIMENT

Figure 1:
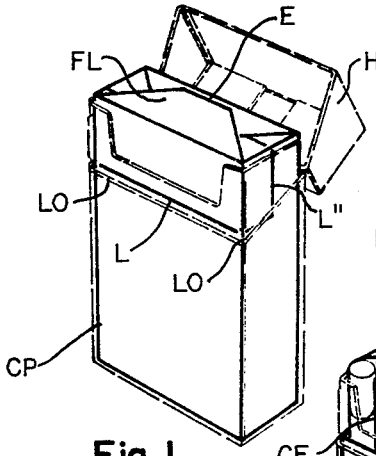
FIG. 1 shows a perspective view of a cigarette packet of the hinge lid type in which can be made with the aid of the device according to the invention.

With particular reference to FIGS. 3 to 7, at N, there is a continuous web of lined foil, guided by means not depicted in the figure to a narrow vertical guide channel defined by two vertical and parallel guide walls 1 and 2.

A horizontal shaft 3 drives the complete device and this, integral at one end with a gearwheel 4, rotates clockwise.

A gear 5 takes its movement from the aforementioned gearwheel 4 and, in turn, causes a gear 6 to rotate.

Gears 5 and 6 are keyed on to the horizontal shafts 7 and 8, respectively, which are placed at the same level, on both sides of and parallel to the vertical plane for the infeeding of the web of lined foil N.

Shafts 7 and 8 have keyed on to them rollers 9 and 10, respectively, which counter rotate in close contact with each other in such a way as to move the web N longitudinally as indicated by the arrow.

On the shaft 8, at a point corresponding to where there is a break in the roller 10, either a disk 11 (see FIG. 5) or, alternatively, a disk 12 (see FIG. 7) is keyed on.

Along their edge, both disks 11 and 12 are provided with a number of cutting areas Z which, in the case of the former extend for 180° and in the case of the latter, extend for 360°, these being designed to produce on the web N, as it moves forward between the rollers 9 and 10, a succession of vertical perforations LA, LB etc.

Figure 4:
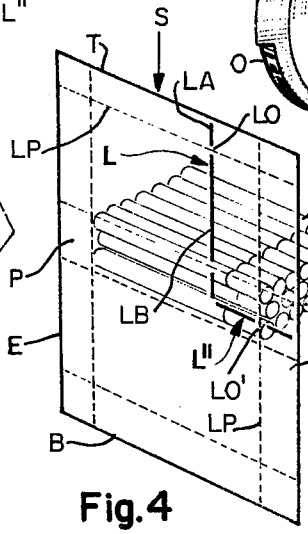
FIG. 4 is a perspective view, of material produced by the device of FIG. 3.
Figure 5:
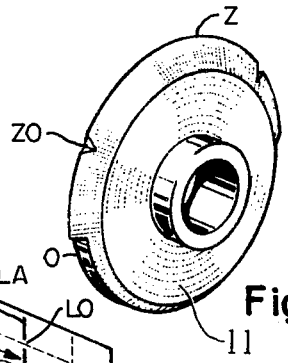
FIG. 5 is a detail from FIG. 3.

To be more precise, when the disk 11 is used, the vertical weakening line L seen on the finished cutting depicted in FIG. 4 is created, which according to the invention, extends parallel to the side edges E of the web N (transversely of the cigarettes C to be wrapped in sheet S cut from web N), from the top edge T of sheet S to a portion P central between top edge T and the bottom edge B of the sheet.

The use of the disk 12, instead, makes it possible to trace the weakening line L′, which extends parallel to the side edges E of the web N (transversely of the cigarettes C to be wrapped in sheet S cut from web N), from the top edge T of sheet S to a portion P central between top edge T and the bottom edge B of the sheet.

Figure 6:
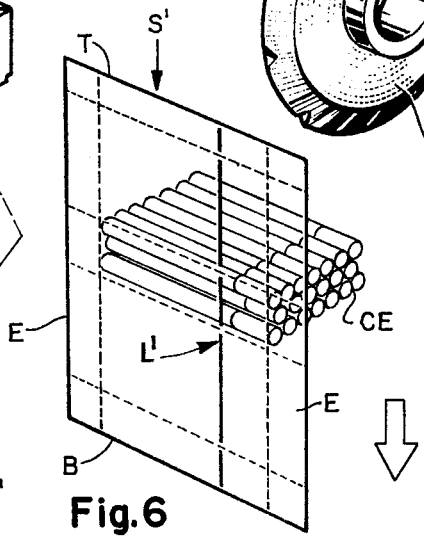
FIG. 6 is a modification of FIG. 4.
Figure 7:
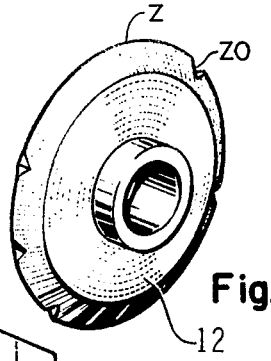
FIG. 7 is a modified detail from FIG. 3.
Figure 3:
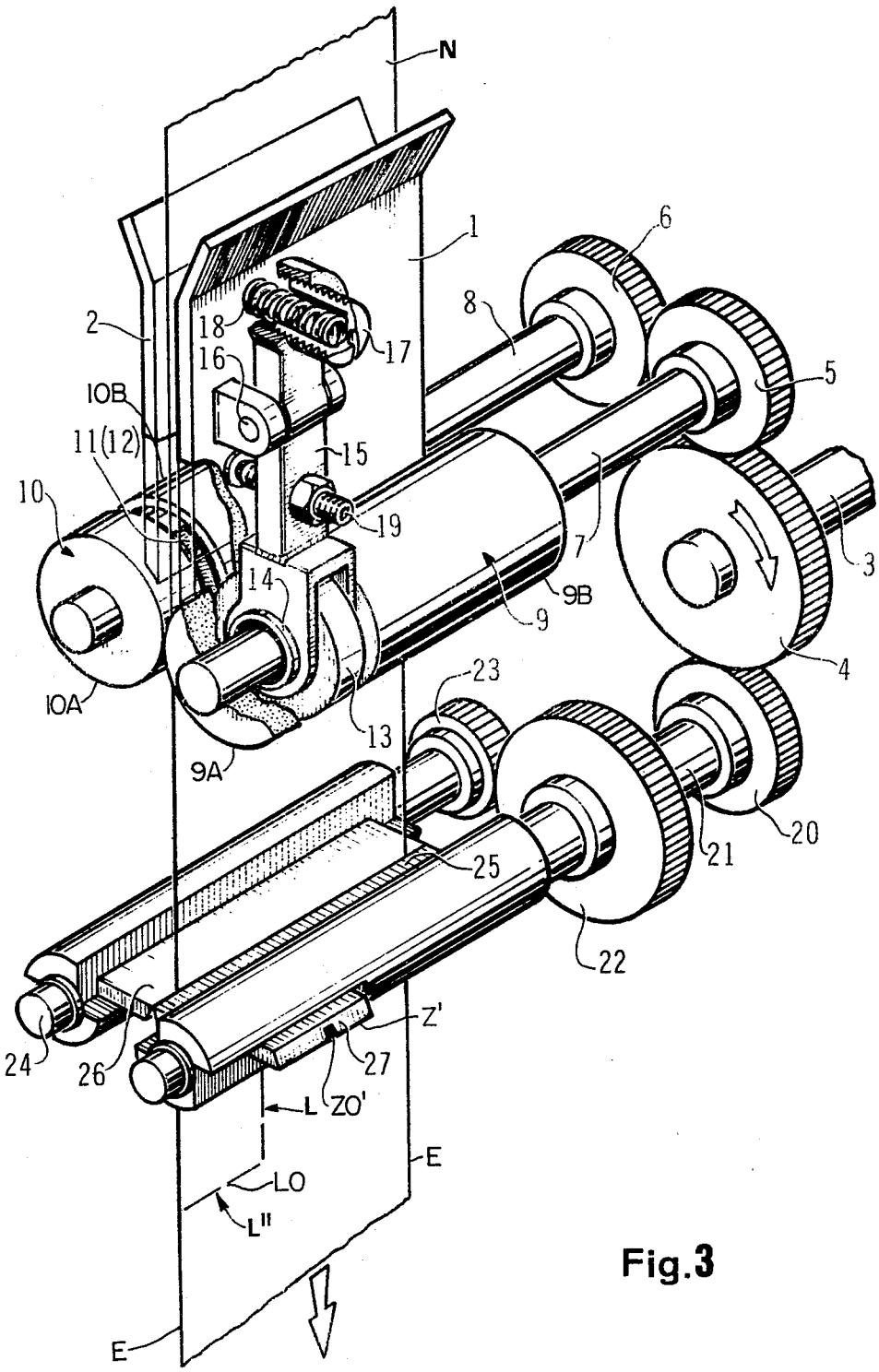
FIG. 3 shows, in a perspective view, the complete device forming the subject of the present invention together with its operating means.

The use of the disk 12, instead, makes it possible to trace the weakening line L′, which extends parallel to edges E from one end T of the sheet or cutting to the other end B, as shown in FIG. 6.

During its cutting operation, the disk 11 (or 12) is restrained or backed up by a roller 13 loosely mounted on shaft 7 between parts 9A, 9B of the roller 9, on a bush 14 able to effect small oscillations with respect to the shaft 7 passing in the inside thereof.

The roller 13 and the bush 14 are, in fact, supported by a vertical two armed lever 15 pivoted on to a horizontal pin 16 parallel with the shafts 7 and 8 and integral with the guide wall 1.

Perpendicularly to the infeed plane of the web N, a hollow screw 17 is mounted on the end of the second arm of lever 15, inside which a spring 18 is placed and this presses against the guide wall 1.

The extent to which the back-up roller 13 applies a restraining action to the cutting edge of the disk 11 (or 12) can be set by means of the hollow screw 17. An adjusting screw 19 is fitted perpendicularly to the infeed plane of the web N to the first arm of the lever 15 and extends toward the guide wall 1. When roller 13 encounters the broken area O between the ends of the cutting edge Z of the disk 11 extending for 180°, screw 19 prevents the roller 13 from exerting a pressing, deforming action on the web N.

Besides carrying in rotation the aforementioned gear 5, the gearwheel 4 also drives a gear 20 keyed on to a shaft 21.

Shaft 21 also has keyed on to it a gear 22 which, in turn, carries in rotation a gear 23 rigidly mounted on a shaft 24.

The shafts 21 and 24 are parallel with the shafts 7 and 8 and they counter rotate at different angular velocities since the ratio between the number of teeth in the gears 22 and 23 is equal to 2.

Furthermore, to the shafts 21 and 24, parallel with their axes, are fixed the rectangular plates 25 and 26, respectively, and these are provided with cutting edges which, coming into reciprocal contact along the infeed plane, detach individual pieces of lined foil, perforated by the disk 11 (or 12), from the continuous web N.

It should be noted that, for the reasons outlined, one piece or sheet S is cut off each time the gear 22 completes a full rotation and each time the gear 23 completes two full rotations.

When the disk 11 is used to trace the vertical perforations, the weakening line L delimitating the part of the inner wrap that can be removed at the time the packet is opened, has to be completed, as already stated, by a line L″ consisting of a number of perforations made transversely with respect to the direction in which the web N moves forward.

This operation is performed by a plate 27 fixed, in a diametrically opposed position to the plate 25, on the shaft 21 and provided along its edge with a plurality of cutting edges Z'.

The plate 27 also operates in conjunction with the cutting edge of the plate 26, alternating with the operation of cutting the individual pieces.

Figure 2:
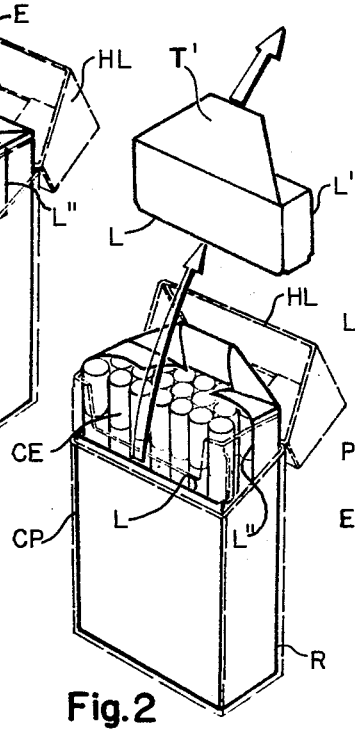
FIG. 2 shows an exploded perspective view of the same packet at the time the inner wrap is opened.
Figure 9:
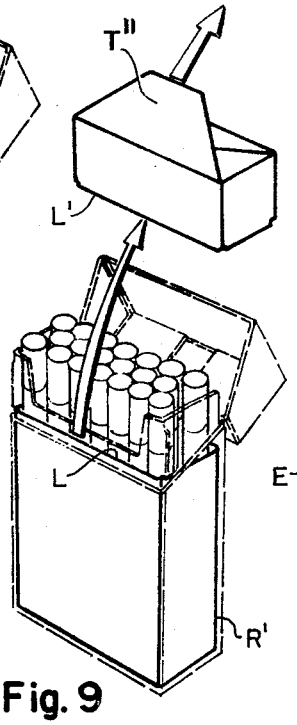

When looking at FIGS. 2 and 9, it can be seen that to detach the removable part T or T' of the inner wrap, tractive force has to be applied to this part.

So as to render this operation easier, it is advisable that the areas connecting the removable part T or T' with the remainder of the inner wrap be positioned in such a way that a bending moment stress be applied thereto at the time of opening.

Figure 8:
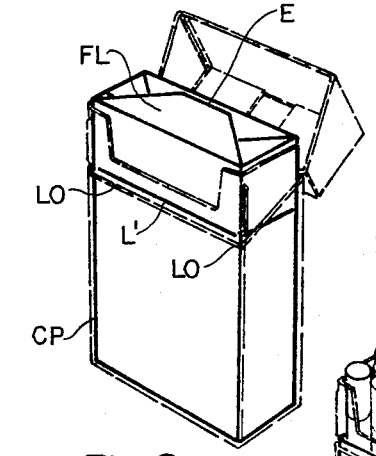
FIGS. 8 and 9 show views corresponding to those of FIGS. 1 and 2, respectively, for a modified hinge lid packet.

This is the reason why the cutting edges Z, Z' of the disks 11 and 12 and of the plate 27 only have breaks ZO, ZO' in them, located so as to provide breaks LO, LO' in the weakening lines L, L'' at points corresponding to where the pre-folding lines LP (shown in dashes in FIGS. 4 and 6) are located, that is to say, the lines which constitute the corners and edges of the inner wrap once the wrap has been completed, in the "soap" style of wrapping produced according to U.S. Pat. No. 3,628,309. This style of wrapping produces an inner wrap CP (FIG. 1) from sheet S (FIG. 6), wherein longitudinal flaps of the sheet are produced and folded over one another on a single side of the batch of cigarettes, and the top and bottom ends of the packet are closed by folding over one another the lateral flaps EL along the edges E, overlying the ends CE of the cigarettes (FIGS. 1, 8). Heretofore, as already mentioned, this style of wrap was available only for soft type cigarette packets. By the present invention, this style of wrap becomes available also for hard type, hinge-lid cigarette packets.

I claim:

1. In a machine for producing inner wrappers for hinge-lid packets of cigarettes, the combination of;

a pair of driving rolls having axes parallel to one another the rolls being disposed to engage mutually opposite surfaces of a continuous web of flexible material for making inner wrappers of batches of cigarettes to be packed in packets of cardboard material having hinge-lids; means for rotating the driving rolls in mutually opposite directions for movement of the web in a direction parallel to longitudinal side edges of the web and transverse of the cigarettes, and of the axes of the driving rolls;

a pair of cutting rolls having axes parallel to those of the driving rolls, each cutting roll having cutting means thereon extending along the roll and transversely of the web; means for rotating the cutting rolls in mutually opposite directions to cut longitudinally successive sheets from the web on rotation of the cutting rolls, each sheet to provide an entire one of the inner wrappers for a batch of cigarettes to be packed in one of the packets having a hinge-lid;

a scoring disk coaxial with one of the driving rolls, rotatable therewith by the means for rotating it and having scoring edge portions for scoring a line of sheet-weakening indentations, parallel to the longitudinal side edges of the web and to the direction of the movement of the web, in each of the sheets, the scored edge portions being spaced apart to leave, in the line of sheet-weakening indentations, sheet portions linking the removable part with the remainder of the wrapper and disposed at corners of the wrapper; and a back-up roller, generally coaxially disposed relative to the other one, of the pair of driving rolls opposite the scoring disk, to thereby provide an end part of each inner wrapper extending transversely of the cigarettes adjacent one end thereof and readily removable from the entire inner wrapper by applying a tractive force to the end part when the hinge-lid of the packet has been opened, for manual breaking of the wrapper along the line of sheet-weakening indentations.

2. A combination according to claim 1, in which circumferential portions of the scoring disk have a plurality of mutually successive ones of the scoring edge portions for making, in the line of sheet-weakening indentations scored in each of the sheets, a plurality of sheet-perforating cuts each extending parallel to the longitudinal side edges of the web to provide the removable part of each wrapper.

3. A combination according to claim 2, in which the scoring disk's scoring edge portions are distributed over the entire circumference of the scoring disk, to shape the removable part of each wrapper so as to define a hood covering an end of the respective batch of cigarettes adjacent the hinge-lid.

4. A combination according to claim 2, in which the scoring disk's scoring edge portions are distributed over one-half of the circumference of the scoring disk, to shape the removable part of each wrapper so as to define a cover overlying a front part of an end of the respective batch of cigarettes adjacent the hinge-lid.

5. A combination according to claim 1 in which at least one of the cutting means comprises a continuous cutting edge extending along the entire respective cutting roll, the means for rotating the cutting rolls being constructed to enable one of the cutting rolls to rotate twice as fast as the other cutting roll of the pair, to promote the cutting of the sheets from the web by moving the cutting edge relative to the cutting means of the respective cutting roll.

6. A combination according to claim 5 in which said one cutting means also has a sheet-weakening edge parallel to the cutting edge but extending only along a part of said one cutting roll corresponding to the location of the scoring disk, for indenting a corresponding portion of each successsive sheet to provide the removable part of each wrapper so as to define a cover overlying a front portion of an end of the respective batch of cigarettes adjacent the hinge-lid.

7. A combination according to claim 1 in which the cutting means of one of the cutting rolls comprises a continuous cutting edge extending along said one roll for cutting the sheets from the web, and a discontinuous cutting edge extending along the same roll parallel to the continuous edge for defining the removable part of each wrapper for a batch of cigarettes, the discontinuous edge having edge portions spaced apart to leave, in the corresponding line of sheet-weakening indentations, small sheet portions linking the removable part with the remainder of the wrapper, the spacing of the edge portions being such that such sheet portions are disposed at corners of the wrapper.

8. A combination according to claim 1 in which the back-up roller has supporting means for rotatably supporting it, in its position generally coaxial with said other one of the pair of driving rolls, subject to adjustment of said position radially of the scoring disk, the supporting means including means for resiliently reacting to said adjustment.

9. A combination according to claim 8 in which the supporting means includes means for limiting the adjustment to a predetermined range of positions of said supporting means, relative to the scoring disk.

* * * * *